United States Patent [19]

Moore, Jr.

[11] 4,271,902

[45] Jun. 9, 1981

[54] SELF-DISCRIMINATING SIDE POCKET MANDREL AND METHOD OF MANUFACTURING SAME

[75] Inventor: Howard H. Moore, Jr., Weimar, Tex.

[73] Assignees: Perry R. Bass, Inc.; Sid W. Richardson Foundation, both of Fort Worth, Tex. ; part interest to each

[21] Appl. No.: 61,417

[22] Filed: Jul. 27, 1979

[51] Int. Cl.[3] ..... E21B 23/03; E21B 23/12; E21B 43/12; F04F 1/20

[52] U.S. Cl. ..... 166/117.5; 29/157 R; 228/174

[58] Field of Search ..... 166/117.5, 117.6, 315, 166/313; 417/109, 313; 29/157 R, 157.1 R; 228/174, 182

[56] References Cited

U.S. PATENT DOCUMENTS

| | | | |
|---|---|---|---|
| 2,280,787 | 4/1942 | Boynton | 417/109 X |
| 2,368,406 | 1/1945 | Boynton | 417/109 |
| 2,824,525 | 2/1958 | McGowen, Jr. . | |
| 2,828,698 | 4/1958 | Bryan | 166/117.5 X |
| 2,846,014 | 8/1958 | Daffin et al. | 166/102 |
| 2,988,146 | 6/1961 | Fredd | 166/117.5 |
| 3,741,299 | 6/1973 | Terral | 166/117.5 |
| 3,874,445 | 4/1975 | Terral | 166/117.5 |
| 4,035,103 | 7/1977 | McMurry et al. | 417/109 |

*Primary Examiner*—Stephen J. Novosad
*Attorney, Agent, or Firm*—Richards, Harris & Medlock

[57] ABSTRACT

A mandrel (10) of simplified construction and reduced cross sectional size for connection in well tubing comprises a cylindrical body (16) defining a main bore (20) for passage of wire line tools therethrough. A longitudinal slot (30) is formed in the cylindrical body (16). A side pocket subassembly (34, 42, 50, and 52) is secured to the body (16) over the longitudinal slot (30) formed in the body. The slot (30) is sized to permit passage of pocket devices only from the main bore (20) through the offset chamber (44) and into the pocket (60). If desired, an orienting member (22) can be provided within the cylindrical body (16).

31 Claims, 5 Drawing Figures

SELF-DISCRIMINATING SIDE POCKET MANDREL AND METHOD OF MANUFACTURING SAME

BACKGROUND OF THE INVENTION

In the production of oil, a well is drilled downwardly from the surface to or through geological zones believed to contain oil. Casing is then positioned in the well bore for reinforcement. The casing is usually cemented in place to prevent crossflow of subsurface fluids between the zones. One or more strings of tubing are then run into the casing, after which oil is lifted through the tubing or external to the tubing and through the casing. Packers are sometimes employed to separate sections of the well between the casing and tubing so that fluids from different zones can be lifted through separate tubing strings.

It has become common practice in the industry to connect side pocket mandrels within the tubing strings at intervals in the well. Such mandrels include main bores in alignment with the interior of the tubing, and offset chambers or side pockets adapted to receive side pocket devices such as gas lift valves or the like. Wire line tools are thus intended to be passed through the tubing, while gas lift valves need to be selectively installed or removed from particular mandrels. In the past, this has oftentimes been done with the aid of kick-over tools.

Side pocket mandrels are particularly useful during gas lift production techniques. Air or natural gas is introduced into the well and allowed to flow through the gas lift valve to reduce the specific gravity of the oil and thus facilitate lifting the oil to the surface. Such techniques are commonly employed with deep wells or with extremely heavy and viscous oil, where production by means of downhole pumps alone would otherwise be difficult.

Several difficulties, however, have been experienced with side pocket mandrels appearing in the prior art.

Because well mandrels operate under conditions of high internal and external pressure, these devices must be of rugged construction capable of withstanding extreme pressure for long periods of time. Specialized techniques, expensive machinery and large capital outlays have been required to manufacture prior art mandrels with adequate pressure ratings. Prior art manufacturing techniques have resulted in mandrels of thicker and heavier construction which occupy more space in the casing and thus reduce the remaining flow space for passage of oil therethrough.

In the past, it has been common to construct a side pocket mandrel from a specially machined oval pipe section, such as shown in FIG. 7 of U.S. Pat. No. 3,741,299, issued to Ben D. Terral. Such construction methods have been unsatisfactory, however, because a separate piece of pipe must be expensively machined for each various size tubing. More specifically, the various sizes of mandrels utilized in the industry have made prior art side pocket mandrels expensive and complicated to manufacture. The size mandrel required depends upon the tubing and gas lift valve sizes suitable for a particular well. Tubing sizes generally vary over a wide range. At the same time, the sizes of conventional gas lift valves only vary over a relatively limited range. In the prior art, each size mandrel had to be specially constructed, even though the same size gas lift valve could be used with several different mandrels having different sizes of associated tubing. A separate piece of oval shaped tubing had to be expensively machined for each gas lift valve and mandrel size combination. Expensive forging dies and upsetting machinery were often required to manufacture prior art mandrels. Prior art methods of constructing side pocket mandrels did not permit interchangeability of side pockets as a means of reducing the overall production cost of mandrels.

Other problems exist with regard to the internal configurations of these mandrels. In particular, the side pocket must be configured to exclude or discriminate against wire line tools which are intended to pass through the mandrel rather than seat in the side pocket. This problem is especially present in slanted or directional wells where tool hangup can occur frequently when the side pocket is positioned on the low side of the tubing. Costly production delays can result from wire line tools becoming caught in the mandrels.

While prior art methods of manufacture have exhibited at least a degree of utility in producing side pocket mandrels, and prior art side pocket mandrels have exhibited a degree of utility, room for significant improvement remains. A need has existed for a new and improved side pocket mandrel which can be manufactured at less expense, and which is structured to better discriminate between tools intended to engage the side pocket and tools which are intended to remain in the main bore of the mandrel regardless of the mandrel orientation.

The problems enumerated in the foregoing are not intended to be exhaustive, but rather are among many which tend to impair the effectiveness of previously known side pocket mandrels and methods of manufacturing such mandrels. Other noteworthy problems may also exist; however, those presented above should be sufficient to demonstrate that side pocket mandrels and methods of manufacturing such mandrels appearing in the prior art have not been altogether satisfactory.

SUMMARY OF A PREFERRED EMBODIMENT OF THE INVENTION

Recognizing the need for an improved side pocket mandrel capable of discriminating between tools intended to pass through the main bore and tools intended to rest in the side pocket, and an improved method of manufacturing side pocket mandrels, it is, therefore, a general feature of the present invention to provide a novel self-discriminating side pocket mandrel and an improved method of manufacturing side pocket mandrels which minimize or reduce the problems of the type previously noted.

It is a more particular feature of the present invention to provide a side pocket mandrel with a discriminating slot which is capable of automatically rejecting wire line tools and other tools intended to be passed through the main bore, and at the same time automatically permitting gas lift valves and other tools as desired to seat in the side pocket. It is a correlated feature of the present invention to provide a side pocket mandrel with the above-described features which may be manufactured relatively inexpensively.

It is a further feature of the present invention of presenting a novel method of manufacture that allows the construction of a side pocket mandrel relatively inexpensively primarily from readily available straight pieces of tube, and which does not require specially made and machined oval sections of tubing which are not readily available and which are relatively expensive. Expensive forging dies and upsetting machinery are not required. The present invention includes the feature of permitting construction by means of cutting and welding operations, thus reducing manufacturing costs.

The present invention comprises an improved side pocket mandrel and method of manufacture thereof which overcome the foregoing and other difficulties associated with the prior art. In accordance with the invention, there is provided a mandrel which can be fabricated at less cost and without expensive forging dies or upsetting machinery. The mandrel disclosed herein is constructed from a section of tube and a side pocket assembly secured thereto over a longitudinal slot formed in the tube. The mandrel is formed primarily from straight pieces of readily available tube which are cut, slotted and welded together. The mandrel of the present invention may achieve higher pressure ratings, has reduced cross sectional size, and is less expensive to construct.

In accordance with more specific aspects of the invention, a self-discriminating side pocket mandrel is provided which comprises a tubular body with a main bore therethrough and a side pocket assembly. The body is threaded or otherwise adapted at the ends for connection in a conventional string of tubing extending into the well casing. The side pocket assembly is welded to the body over a longitudinal slot in the body. The slot is of a predetermined length and width. The side pocket assembly includes a semi-cylindrical section and a ported structure defining a pocket for the gas lift valve. The slot in the body is narrower than the internal diameter of the main bore such that wire line tools other than gas lift valves are prevented from entering or even snagging on the side pocket during passage through the mandrel.

Examples of the more important features of this invention have thus been given broadly in order that the detailed description thereof that follows may be better understood, and in order that the contribution to the art may be better appreciated. There are, of couse, additional features of the invention which will be described hereinafter and which will also form the subject of the claims appended hereto.

DETAILED DESCRIPTION OF A PREFERRED EMBODIMENT OF THE INVENTION

Figure 1:
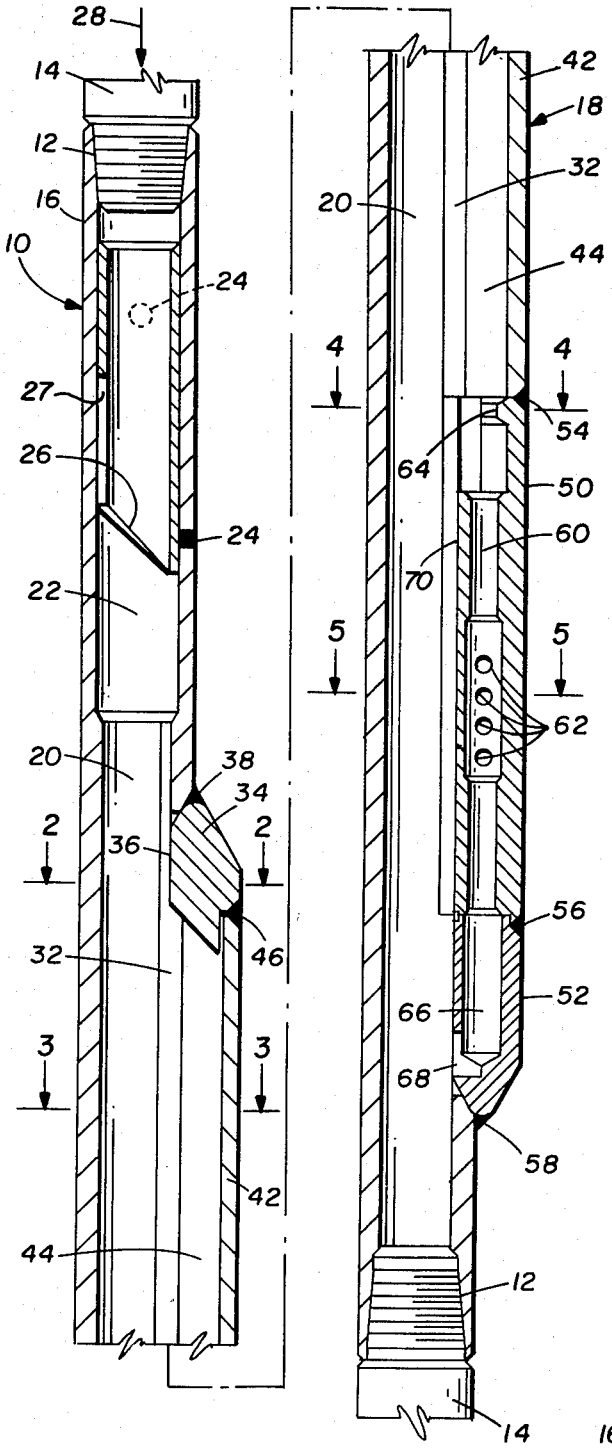
FIG. 1 is a broken vertical section view illustrating a side pocket mandrel incorporating the invention.

Referring now to the Drawings, wherein identical reference numerals designate like or corresponding parts throughout the several views, and particularly referring to FIG. 1, there is shown a side pocket mandrel 10 incorporating the invention. In the illustrated embodiment, both ends of mandrel 10 are provided with female threads 12 for receiving the male threads on sections of tubing 14 extending inside the well casing (not shown).

Mandrel 10 is comprised of a tubular main body 16 and a side pocket assembly 18. Body 16 comprises a straight section of metal tubing which defines a cylindrical bore 20 extending therethrough. Female threads 12 are provided in bore 20 at opposite ends of body 16. Body 16 preferably comprises a section of external tubing of suitable material, size and wall thickness. The particular material, size and wall thickness may vary depending upon the particular well and the partaicular casing or tubing employed in the well, all as will be apparent to those skilled in the art. For example, in practice, a body 16 approximately 71 inches long with a size OD of 2.375, a coupling OD of 2.881, an ID of 1.995, a drift of 1.901 and a wall thickness of 0.190, has given satisfactory results. It will be understood that the OD of body 16 may vary widely. For example, an OD ranging between two and seven inches may be employed, as desired. It will be further understood that the present invention is not necessarily limited to a specific set of dimensions for body 16. Body 16 can thus be formed from a straight section of readily available tubular metal stock of the desired size.

If desired, an orienting sleeve 22 may be provided in mandrel 10 between the upper end of body 16 and side pocket assembly 18. In the illustrated embodiment, orienting sleeve 22 is secured in place within mandrel 10 by plug welds 24 or other suitable means of fastening. Orienting sleeve 22 may be of substantially conventional construction, and typically includes a helical cam surface 26 or a longitudinal guideway 27 for engagement with particular wire line tools lowered in the direction of arrow 28 through tubing 14 and mandrel 10. Sleeve 22 functions to properly orient a kickover tool or the like with respect to side pocket assembly 18. For example, a kickover tool such as that shown in U.S. Pat. No. 3,837,398 can be oriented with a guide sleeve like that illustrated in U.S. Pat. No. 3,610,336 comprising sleeve 22. It will thus be understood that an optional orienting means can be provided in mandrel 10 near the upper end of tubular body 16.

Figure 2:
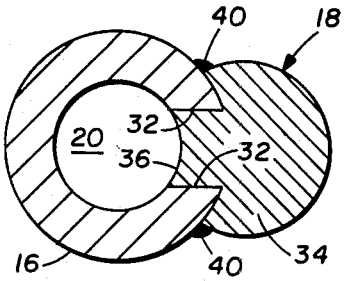
FIG. 2 is a sectional view taken along lines 2—2 of FIG. 1 in the direction of the arrows.
Figure 3:
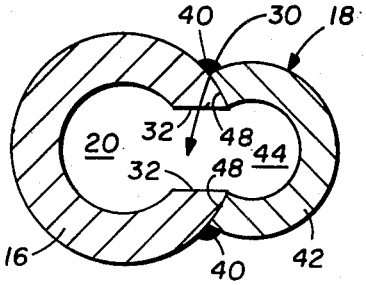
FIG. 3 is a sectional view taken along lines 3—3 of FIG. 1 in the direction of the arrows.

Referring now to FIGS. 2 and 3 in conjunction with FIG. 1, body 16 is provided with a longitudinal discrimination slot 30 over which side pocket assembly 18 is secured. A torch or other suitable cutting tool can be used to form slot 30 in body 16. Discrimination slot 30 is substantially rectangular in configuration having a length shorter than body 16 and a width preferably narrower than the inside diameter of bore 20 therein. As is best seen in FIGS. 2 and 3, the end surfaces 32 of body 16 define the longitudinal sides of discrimination slot 30. The width of discrimination slot 30 is preferably substantially less than the internal diameter of main bore 20 and the external diameter of main bore wire line tools in order that wire line tools cannot enter side pocket assembly 18 via slot 30. Slot 30 should be wide enough to pass a lift valve or other pocket device. In practice, a width of one to one and a half inches has given satisfactory results and will accommodate typical gas lift valves. Surfaces 32 may be parallel as illustrated, but may also be beveled about the periphery of slot 30 if desired. It will be appreciated that the upper and lower ends of slot 30 can be either square or rounded, as desired.

Slot 30 is dimensioned in accordance with the size of side pocket assembly 18, and with the size of the particular lift valve, lock or flow control element (not shown)

to be received within the side pocket assembly. Slot 30 is preferably no wider than is necessary to pass those tools which the side pocket assembly 18 is to receive, while preventing entry of the undesired tools. The C-shaped cross section of body 16 adjacent assembly 18 tends to function as a mechanical discriminator against those tools which should not enter the side pocket assembly, even if the well is slanted.

Referring to FIGS. 1 and 2, the upper end of side pocket assembly 18 is shown to include a solid plug 34. The interior face 36 of plug 34 preferably has a radius of curvature matching the internal diameter of main bore 20 in body 16, as is best seen in FIG. 2. The longitudinal edges of plug 34 are preferably notched as shown to receive the end surfaces 32 of main tube 16. The upper end of plug 34 is preferably beveled to match a corresponding bevel formed on the upper end of slot 30, and is secured to body 16 by means of weld 38. Welds 40 extend longitudinally along mandrel 10 and are provided at the junction between the exterior surfaces of body 16 and plug 34 to further secure the side pocket assembly 18 to the tubular body.

Referring to FIGS. 1 and 3, a cap 42 of C-shaped cross section defining a side pocket bore 44 extends downwardly from upper plug 34. The internal diameter of bore 44 can be equal to or larger than the width of slot 30. Cap 42 is formed from a longitudinally slotted straight section of tubing, or a semi-cylindrical section of tubing, having the desired wall thickness. The upper end of cap 42 is received in a notched portion of plug 34, as is best seen in FIG. 1, and secured thereto by a circumferential weld 46. The end surfaces 48 of cap 42 are cut so as to butt against the exterior surface of body 16 adjacent to the end surfaces 32 thereof. Body 16 and cap 42 are interconnected by longitudinal welds 40 extending along the junctions between the exterior surfaces of the tube and cap. The relatively smaller bore 44 in side pocket assembly 18 is thus open to main bore 20 in body 16 along substantially the entire length of cap 42.

If desired, a single piece could be substituted for upper plug 34 and cap 42 in side pocket assembly 18. Such a piece could be of a section of slotted tubing with a closed end taking the place of plug 34. It will be understood that a slotted section of closed end tubing is considered equivalent to plug 34 and cap 42 herein and within the scope of the present invention.

Figure 4:
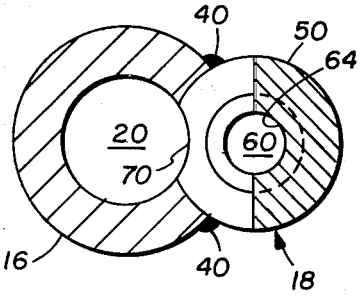
FIG. 4 is a sectional view taken along lines 4—4 of FIG. 1 in the direction of the arrows.
Figure 5:
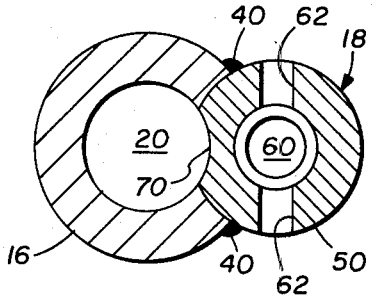
FIG. 5 is a sectional view taken along lines 5—5 of FIG. 1 in the direction of the arrows.

Referring to FIGS. 1, 4 and 5, side pocket assembly 18 further includes a valve housing 50 and bottom plug 52 which define a pocket for receiving a gas lift valve (not shown) or other flow control device. Housing 50 can be machined from a section of open-end tubing, and plug 52 can be formed from a section of closed-end tubing. Housing 50 and plug 52 are secured to body 16 by means of longitudinal welds 40. Housing 50 and cap 42 are interconnected by circumferential weld 54. Bottom plug 52 and housing 50 are interconnected by circumferential weld 56. The lower end of plug 52 is secured to body 16 with weld 58.

Valve housing 50 includes a tubular pocket 60 for receiving a lift valve (not shown) which controls the flow of gas through ports 62 and thus between mandrel 10 and the well casing. Valve housing 50 preferably includes a latching shoulder 64 for engagement with a latch like that shown in U.S. Pat. No. 3,874,447. It is understood, of course, that the mandrel of the present invention could be constructed to fit various types and shapes of latches. The nose of the gas lift valve (not shown) or other flow control device seats in pocket 60 of housing 50 and bore 66 of bottom plug 52. Fluid communication between main bore 20, body 16 and pocket 60 is provided by cross bore 68 in bottom plug 52. The interior face 70 of housing 50 and that of plug 52 preferably have a radius of curvature matching the internal diameter of bore 20 in body 16, as is best seen in FIGS. 4 and 5.

If desired, valve housing 50 and bottom plug 52 in side pocket assembly 18 can be constructed from a single piece of closed-end tubing. It will be understood that a single piece of closed-end tubing defining a side pocket for receiving a gas lift valve or the like is considered equivalent to housing 50 and plug 52 and within the scope of the present invention.

If desired, cap 42 and valve housing 50 can be constructed from a single piece of tubing. Such a piece could be a section of straight tubing with a slotted upper portion of C-shaped cross section corresponding to cap 42 and a machined lower portion corresponding to housing 50. It will be understood that one section defining an offset chamber and side pocket for receiving a gas lift valve is considered equivalent to cap 42 and housing 50 and within the scope of the invention.

Mandrel 10 is manufactured as follows. A straight section of tubing of the desired internal diameter and wall thickness is first measured, cut to length and machined as necessary for use as body 16. If desired, at this time, an orienting sleeve 22 can be secured inside body 16 near the upper end thereof.

Longitudinal slot 30 is then cut in the side of body 16. The length and width of slot 30 are selected to correspond with the size of side pocket assembly 18 to be connected to body 16, as well as the size of the lift valve or other flow control elements to be received by the side pocket assembly. The width of slot 30 is less than the diameter of main bore 20, and preferably no wider than necessary to permit passage of the lift valve.

Following formation of longitudinal slot 30, side pocket assembly 18 is secured to main tube 16. Assembly 18 includes an upper plug 34, semi-cylindrical cap 42, valve housing 50 and bottom plug 52 all of which are interconnected by circumferential welds 46, 54 and 56, and secured to main body 16 by longitudinal welds 40. Side pocket assembly 18 can be secured to body 16 as a unit, or by its separate elements.

In accordance with the preferred construction, housing 50 and bottom plug 52 are first joined together by weld 56, and are then positioned over the lower end of slot 30 in tube 16. Housing 50 and plug 52 are then secured to tube 16 with welds 40 and 58. Cap 42 is then positioned over slot 30 in tube 16 over housing 50, and is secured to the housing by weld 54. Cap 42 is also secured to tube 16 by weld 40. Finally, upper plug 34 is positioned above cap 42, secured to the cap by weld 46, and secured to main tube 16 by welds 38 and 40 to close slot 30.

After the joining of body 16 and side pocket assembly 18, the entire mandrel 10 is preferably heat treated to increase strength and relieve residual stresses caused by the welding operations. Female threads 12 for connection to conventional well tubing 14 can be provided in opposite ends of body 16 following the heat treating process.

SUMMARY OF ADVANTAGES OF THE INVENTION

From the foregoing, it will be appreciated that the present invention comprises an improved side pocket mandrel and method of manufacturing same having numerous advantages over the prior art. One significant advantage involves the fact that the mandrel herein is internally configured to exclude wire line tools other than lift valves and the like from entering or even snagging the side pocket. Another advantage is that the present invention is primarily comprised of sections of readily available tubular materials which are assembled by means of straight-forward cutting and welding operations so as to reduce manufacturing costs. Expensive equipment such as forging dies or upsetting machines are not required to construct the mandrel herein. Other advantages will suggest themselves to those skilled in the art, having the benefit of the foregoing detailed description.

The foregoing description of the invention has been directed to a particular preferred embodiment in accordance with the requirements of the Patent Statutes and for purposes of explanation and illustration. Although the present invention has been described in conjunction with specific forms thereof, it is evident that many alternatives, modifications and variations will be apparent to those skilled in the art in light of the foregoing disclosure. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. A mandrel for connection in well tubing, which comprises:

a cylindrical body with upper and lower ends, said body having an open bore of predetermined internal diameter extending therethrough for alignment with the well tubing and for passing wire line tools through said body;

said body including a longitudinal discrimination slot having upper and lower ends and being of predetermined length and width formed therein, the length of said discrimination slot being less than the length of said body;

side pocket means secured to said body over the discrimination slot therein for defining a longitudinal chamber and pocket laterally offset from the open bore to receive only pocket devices, the width of the discrimination slot in said body between said chamber and the open bore being less than the internal diameter of the open bore and being adapted to admit only pocket devices into said side pocket means while keeping wire line tools other than pocket devices from leaving the open bore of said body and entering into said side pocket means; and an end plug secured to said side pocket means and to said body for closing the offset chamber;

a portion of said side pocket means extending into the discrimination slot and cooperating with said body such that the open bore is of substantially uniform circular cross section along the discrimination slot.

2. The mandrel of claim 1, wherein said cylindrical body comprises a section of straight tubing of circular cross section and predetermined wall thickness.

3. The mandrel of claim 1, wherein said cylindrical body includes threads integrally formed therein adjacent the upper and lower ends.

4. The mandrel of claim 1, further comprising:

orienting means mounted in the open bore between said side pocket means and the upper end of said body for positioning a pocket device in proper angular orientation relative to said side pocket means.

5. The mandrel of claim 1, wherein said side pocket means comprises:

structure positioned within the lower end of said discrimination slot in said cylindrical body defining a pocket for receiving a pocket device;

said pocket structure being ported to the outside and to the open bore; and, a generally semi-cylindrical member positioned over the upper end of said discrimination slot in said body, said member defining a longitudinal bore of predetermined internal diameter at least as great as the width of said discrimination slot in said body.

6. A side pocket mandrel for connection in well tubing, comprising in combination:

a cylindrical body with a cylindrical wall defining an axial main bore of circular cross section and predetermined diameter extending through the length of said body;

said body including a longitudinal slot through the wall thereof having a length less than the length of said body and having a width substantially less than the diameter of the main bore;

tubular side pocket means welded to said body over the slot for receiving a pocket device;

said side pocket means having an axial side bore therein of circular cross section and predetermined diameter substantially equal to the width of slot in said body, the side bore being defined by a semi-cylindrical wall with a longitudinal slot therein aligned with the slot in said body for access between the side bore and the main bore; and means secured to said body for sealing the ends of said pocket means.

7. The side pocket mandrel of claim 6, said side pocket means forming a pocket, wherein the pocket in said side pocket means comprises:

structure defining a cylindrical pocket laterally offset from the bore in said cylindrical body, said pocket being configured to receive a gas lift valve, said pocket structure being ported to the outside and to the bore in said tubular body.

8. The side pocket mandrel of claim 6, wherein said side pocket means further comprises:

pocket structure defining a cylindrical pocket for receiving a gas lift valve;

said pocket structure including a valve seat for engaging the gas lift valve received thereby;

said pocket structure being ported to the outside and to the main bore.

9. The side pocket mandrel of claim 6, wherein said means for sealing the ends of said pocket means comprises plug members welded between said side pocket means and said cylindrical body.

10. A mandrel for connection in well tubing, which comprises:

a tubular body with upper and lower ends, said body having a cylindrical wall defining an open axial bore of predetermined internal diameter extending therethrough in alignment with the well tubing for passing wire line tools through said body;

said body including a longitudinal slot of predetermined length and width formed therein, said slot having upper and lower ends;

pocket structure located in the lower end of the longitudinal slot and secured to said body defining a longitudinal pocket laterally offset from the open bore for receiving a pocket device;

said pocket structure extending into the longitudinal body slot and cooperating with said body such that the open bore is of substantially uniform circular cross section along said slot, and being ported to the outside and to the open bore; and, offset chamber structure secured to said body over the upper end of the longitudinal body slot defining a longitudinal chamber laterally offset from the open bore for guiding a pocket device into said pocket structure, said offset chamber structure having a predetermined internal diameter at least as great as the width of said slot in said body, the width of said slot between said offset chamber and the open bore being less than the internal diameter of the open bore and being sufficiently small to admit only pocket devices into said offset chamber structure and said pocket structure while preventing wire line tools other than pocket devices from leaving the open bore.

11. The mandrel of claim 10, wherein said tubular body further includes threads integrally formed therein adjacent the upper and lower ends.

12. The mandrel of claim 10, further comprising:

orienting means mounted in the open bore between said offset chamber structure and the upper end of said body for positioning a pocket device in proper angular orientation prior to entry in said offset chamber and receipt by the pocket.

13. The mandrel of claim 10, wherein said offset chamber structure further comprises:

a section of substantially straight semi-cylindrical tubing of predetermined wall thickness positioned above said pocket structure and secured to said body over said slot therein; and, a plug member secured to said body between the upper end of said slot and said semi-cylindrical member.

14. A mandrel for connection in well tubing, comprising:

a cylindrical body of predetermined wall thickness with upper and lower ends and defining an open bore in alignment with the well tubing, the open bore of said body being of predetermined internal diameter for passage of wire line tools;

said body including a longitudinal slot of predetermined length and width having upper and lower ends;

side pocket structure positioned in the lower end of the body slot and secured to said body in laterally offset relationship with the open bore for engaging a pocket device;

a portion of said side pocket structure extending into the body slot and cooperating with said body such that the open bore is of substantially uniform circular cross section along said pocket structure;

a member of C-shaped cross section secured to said body over said slot above said side pocket structure, said member defining an offset chamber of predetermined internal diameter relatively smaller than the internal diameter of the open bore;

the width of said slot in said body interconnecting the open bore and said offset chamber being less than the internal diameter of the open bore, the width of said slot in said body being sufficiently wide to admit a pocket device into said offset chamber and said side pocket structure while excluding wire line tools other than pocket devices therefrom; and a plug member secured to said body between the upper end of said slot and said C-shaped member.

15. The mandrel of claim 14, wherein said cylindrical body further comprises a section of substantially straight tubing of circular cross section and predetermined wall thickness.

16. The mandrel of claim 14, wherein said cylindrical body further includes threads integrally formed therein adjacent the upper and lower ends.

17. The mandrel of claim 14, further comprising:

orienting means mounted in the open bore adjacent to the upper end of said body for positioning a wire line tool in proper angular orientation relative to the offset chamber and side pocket structure.

18. A method of manufacturing a side pocket mandrel from three sections of cylindrical metal tubing, the first section of tubing having an internal diameter to receive a well string and the second and third sections of tubing each having a smaller internal diameter of a size to receive side pocket devices therein, comprising the steps of:

(a) forming in said first section of tubing a longitudinal slot having a predetermined width narrower than the internal diameter of said first section of tubing but no wider than the internal diameter of said second and third sections of tubing, and having a shorter axial length than said first section of tubing;

(b) forming in said second section of tubing a longitudinal slot of a width corresponding to the width of the slot in said first section of tubing;

(c) forming in said third section of tubing an internal side pocket subassembly for receiving pocket devices;

(d) forming an external portion of said third section of tubing to fit into the slot of said first section of tubing and substantially match the internal diameter thereof;

(e) positioning said third section of tubing in the lower end of the slot in said first section of tubing;

(f) positioning said second section of tubing above said third section of tubing and over the upper end of the slot in said first section of tubing with the slots therein aligned to provide communication between the interiors of said first and second tubing sections;

(g) interconnecting said first, second and third sections of tubing by welds;

(h) closing the upper end of said second tubing section; and (i) forming coupling means on the ends of said first tubing section of a size and shape to allow connection of said mandrel to a tubing string.

19. The method of claim 18, where in step (h) comprises the steps of:

forming an end plug to close the upper end of said second section of tubing; and welding said end plug to said first and second sections of tubing.

20. The method of claim 19, further comprising the steps of:

forming an orienting sleeve to be positioned inside said first section of tubing for engagement with side pocket devices; and, welding said orienting sleeve to said first section of tubing.

21. The method of claim 18, further comprising the steps of:

forming an orienting sleeve to be positioned inside said first section of tubing for engagement with side pocket devices; and, welding said orienting sleeve to said first section of tubing.

22. The mandrel formed according to the method of claim 18.

23. A method of manufacturing a side pocket mandrel, comprising the steps of:

(a) forming a longitudinal slot of predetermined width into a straight section of cylindrical tubing, said cylindrical tubing having a predetermined length, wall thickness and internal diameter;

the width of the slot in said cylindrical tubing being less than the internal diameter thereof and dimensioned to pass only pocket devices while preventing wire line tools other than pocket devices from leaving said cylindrical tubing;

(b) providing a side pocket subassembly internally adapted to receive side pocket devices and externally adapted to fill a portion of the slot in said cylindrical tubing;

(c) positioning said side pocket subassembly in the lower end of the slot in said cylindrical tubing;

(d) securing said subassembly to said cylindrical tubing;

(e) positioning a straight section of generally semi-cylindrical tubing over the upper end of the slot formed in said cylindrical tubing above said side pocket subassembly, said semi-cylindrical tubing having predetermined length, wall thickness and internal diameter;

the internal diameter of said semi-cylindrical tubing being substantially equivalent to the width of the slot in said cylindrical tubing to define an offset chamber for guiding pocket devices into said side pocket subassembly;

(f) securing said semi-cylindrical tubing to said cylindrical tubing and to said side pocket subassembly;

(g) providing a plug adapted to close the upper end of said semi-cylindrical tubing;

(h) positioning said plug in the upper end of the slot formed in said cylindrical tubing above said semi-cylindrical tubing to close the upper end of said semi-cylindrical tubing; and (i) securing said plug to said cylindrical tubing and to said semi-cylindrical tubing.

24. The method of claim 23, further comprising the step of:

threading the ends of said cylindrical tubing for connecting the mandrel to well tubing.

25. The method of claim 23, further comprising the step of:

heat treating said cylindrical tubing, said pocket subassembly, said semi-cylindrical tubing and said plug after assembly thereof into the mandrel.

26. The method of claim 23, further comprising the steps of:

positioning an orienting member inside said cylindrical tubing adjacent the upper end thereof; and, securing said orienting member to said cylindrical tubing.

27. The mandrel manufactured according to the method of claim 23.

28. A method of manufacturing a side pocket mandrel, comprising the steps of:

(a) forming a longitudinal slot of predetermined width into a straight section of cylindrical metal tubing having a predetermined length, wall thickness and internal diameter;

the width of the slot in said cylindrical tubing being dimensioned to pass only pocket devices while excluding entry of wire line tools other than pocket devices;

(b) providing a ported metal side pocket subassembly internally adapted to receive pocket devices and externally adapted to fill the lower end of the slot in said cylindrical tubing;

(c) positioning said side pocket subassembly in the lower end of the slot in said cylindrical tubing such that said subassembly is laterally offset from the interior of said cylindrical tubing;

(d) welding said side pocket subassembly to said cylindrical tubing;

(e) providing a straight section of semi-cylindrical metal tubing with an internal diameter substantially equivalent to the width of the slot in said cylindrical tubing;

(f) positioning said section of semi-cylindrical tubing over the upper end of the slot in said cylindrical tubing in abutment with said side pocket subassembly such that said semi-cylindrical tubing defines a chamber laterally offset from the interior of said cylindrical tubing for guiding pocket devices into said subassembly;

(g) welding said semi-cylindrical tubing to said side pocket subassembly and to said cylindrical tubing;

(h) providing a metal plug adapted to close the upper end of the semi-cylindrical tubing and fill the upper end of the slot in said cylindrical tubing;

(i) positioning said plug in the upper end of the slot in said cylindrical tubing in abutment with said semi-cylindrical tubing to close the slot;

(j) welding said plug to said cylindrical tubing and to said semi-cylindrical tubing; and (k) threading the ends of said cylindrical tubing to connect the mandrel in well tubing.

29. The method of claim 28, further comprising the step of:

heat treating said cylindrical tubing, said side pocket subassembly, said semi-cylindrical tubing and said plug after assembly thereof into the mandrel.

30. The method of claim 28, including the steps of:

positioning an orienting member inside the cylindrical tubing adjacent the upper end thereof; and, securing said orienting member to said cylindrical tubing.

31. The mandrel manufactured according to the method of claim 28.

* * * * *